United States Patent [19]

Miyamoto

[11] Patent Number: 4,994,854

[45] Date of Patent: Feb. 19, 1991

[54] IMAGE FORMING APPARATUS FOR FORMING OUTLINE AND NORMAL IMAGES

[75] Inventor: Hirohisa Miyamoto, Osaka, Japan

[73] Assignee: Minolta Camera Kabushiki Kaisha, Osaka, Japan

[21] Appl. No.: 222,167

[22] Filed: Jul. 21, 1988

[30] Foreign Application Priority Data

Jul. 21, 1987 [JP] Japan ..... 62-182836

[51] Int. Cl.[5] ..... G03G 15/00; G03G 15/01; G03G 21/00

[52] U.S. Cl. ..... 355/210; 355/218; 355/225; 355/326

[58] Field of Search ..... 355/200, 210, 214, 218, 355/225, 326, 327

[56] References Cited

U.S. PATENT DOCUMENTS

| | | | |
|---|---|---|---|
| 3,960,445 | 6/1976 | Drawe | 355/326 |
| 3,967,891 | 7/1976 | Rippstein | 355/225 X |
| 4,657,376 | 4/1987 | Ide | 355/309 |
| 4,745,437 | 11/1988 | Oka | 355/265 |
| 4,785,331 | 11/1988 | Oka et al. | 355/77 X |
| 4,866,474 | 9/1989 | Kinoshita et al. | 355/225 X |

FOREIGN PATENT DOCUMENTS

| | | |
|---|---|---|
| 51-134635 | 11/1976 | Japan . |
| 54-30833 | 3/1979 | Japan . |

*Primary Examiner*—Fred L. Braun

*Attorney, Agent, or Firm*—Wenderoth, Lind & Ponack

[57] ABSTRACT

The image forming apparatus includes first developing unit, a unit mounting portion, a detecting apparatus, input apparatus and a mode controller. Either an outline forming unit or a second developing unit for developing a latent electrostatic image is mounted on the unit mounting portion. The detecting apparatus detects which of the outline forming unit and the second developing unit is mounted on the mounting portion. The input apparatus selects one of an outline forming mode, a first developing mode and a second developing mode. The mode controller controls the first and the second developing unit and the outline forming unit according to any of the modes based on the information from the detecting apparatus and the input apparatus. The mode controller can select either the outline forming mode or the first developing mode when the outline forming unit is detected by the detecting apparatus. The mode controller can select either the first developing mode or the second developing mode when the second developing unit is detected by the detecting apparatus.

6 Claims, 13 Drawing Sheets

FIG.12A
OUTLINE
FIG.12B
OUTLINE
FIG.13A
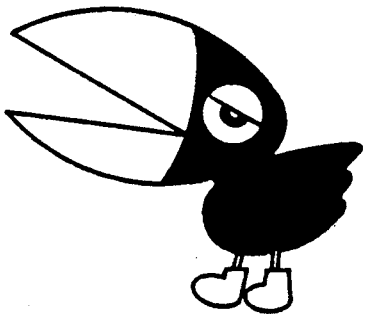
FIG.13B
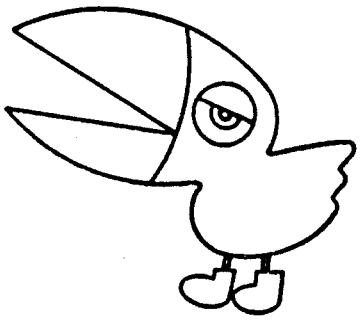

FIG.16A placed on the Original Glass side by side, on two consecutive sheets or on both sides of a single sheet of copy paper at [redacted] touch of the Print Key. The File Margin Shift Function. This [redacted] provides for an additional file margin on one side of a copy for stapling or filing. The 1-Way Sizing [redacted] Function. When copies are made using this function, an

FIG.16B placed on the Original Glass side by side, on two consecutive sheets or on both sides of a single sheet of copy paper at [ ] touch of the Print Key. The File Margin Shift Function. This [ ] provides for an additional file margin on one side of a copy for stapling or filing. The 1-Way Sizing [ ] Function. When copies are made using this function, an

IMAGE FORMING APPARATUS FOR FORMING OUTLINE AND NORMAL IMAGES

BACKGROUND OF THE INVENTION

1. Field of the Invention

The present invention relates to an image forming apparatus and, more specifically, to an image-forming apparatus for forming an image with an enhanced outline.

2. Description of the Prior Art

Generally, outlines of images contain much information and significantly show the characteristics of the images. Therefore, the outlines are important parts in images. In addition, binary processed images of outlines drawn out enable easier handling than normal images having variable density in various processes such as in image-identification. Therefore, the binary processing of the outlines of images is very effective in association with pattern recognition of the image, enhancement, and so on. In addition, a colored outline provided around a black pattern by repeating two copying operations is useful to attract attention, and outlines are useful to provide patterns of different colors produced by painting within respective patterns with different colors.

The applicant of the present invention has proposed methods for forming a positive outline image from a positive original in U.S. Pat. Nos. 4,794,062 and 4,792,775, both issued on Dec. 27, 1988. In these methods, a scorotron charger is provided between an exposing position and a developing position, and provides charges of the polarity opposite to the charges applied on a surface of a recording medium during a charging process. The grid voltage of the scorotron charger is set sufficiently lower than the potential of a latent electrostatic image formed on a surface of the recording medium and lower than the developing bias voltage applied to the developing device.

When such a capability is added to a copying machine, operation keys and display devices are accordingly added, causing manufacturing costs to soar. In addition, the operation panel becomes complicated, rendering the operation troublesome for an operator.

SUMMARY OF THE INVENTION

An object of the present invention is to provide an image forming apparatus capable of forming an image with an enhanced outline or of forming an outline image of the original image without difficulty.

Another object of the present invention is to provide an image forming apparatus in which a mode can be designated only among operable image forming modes, whereby the mode switching is made simple.

A further object of the present invention is to provide an image forming apparatus without any special keys for starting the operation of the outline forming unit and the like, thereby suppressing manufacturing costs.

A still further object of the present invention is to provide an image forming apparatus without any special display or the like for displaying a mode of the outline forming, thereby suppressing the manufacturing costs.

The present invention provides an electrophotographic image forming apparatus for forming an image with an enhanced outline with a scorotron charger which Applies desired charges to a latent electrostatic image formed on a photoreceptor drum.

According to the first aspect of the present invention, the image forming apparatus comprises a first developing unit, a unit mounting portion, an exchangeable unit, detecting means, input means, and mode control means. The first developing unit is opposed to the photoreceptor drum and develops latent electrostatic images on the photoreceptor drum. The unit mounting portion is located behind to the first developing unit in the direction of rotation of the photoreceptor drum. The exchangeable unit is detachably set in the unit mounting portion. Either an outline forming unit having the scorotron charger or a second developing unit developing latent electrostatic images is selected as the exchangeable unit. The detecting means determines whether the exchangeable unit set in the. mounting portion is the outline. forming unit or the second developing unit. The input means selects one of an outline forming mode, first developing mode, and second developing mode. In the outline forming mode, the outline forming unit and the first developing unit operate, whereby images with enhanced outlines-are formed. In the first developing mode, the first developing unit operates to form images of the color developed by the first developing unit. In the second developing mode, the second developing unit operates to form images of the color developed by the second developing unit. The mode control means controls the first developing unit and the exchange unit in accordance with any of the modes based on the information from the detecting means and from the input means. When the outline forming unit is detected by the detecting means, the mode control means can select either the outline forming mode or the first developing mode. When the second developing unit is detected by the detecting means, the mode control means-can select either the first developing mode or the second developing mode.

According to the second aspect of the present invention, the image forming apparatus comprises a first unit mounting portion, a first developing unit, first detecting means, a second unit mounting portion, an exchangeable unit, detecting means, input means, and mode control means. The first unit mounting portion is opposed to the photoreceptor drum. The first developing unit is detachably set in the first unit mounting portion, for developing latent electrostatic images. The first detecting means detects the development color of the first developing unit set in the first unit mounting portion. The second unit mounting portion is located behind the first unit mounting portion in the direction of rotation of the photoreceptor drum. The exchangeable unit is detachably set in the second unit mounting portion Either an outline forming unit having a scorotron charger or a second developing unit developing latent electrostatic images is selected as the exchangeable unit. The second detecting means detects whether the unit set in the second mounting portion is the outline forming unit or the second developing unit, and in addition, it detects the development color of the second developing unit if the same is so set in the second mounting portion. The input means selects one of the outline forming mode, first developing mode and second developing mode. In the outline forming mode, the outline forming unit and the first developing unit operate to form an image with an enhanced outline. In the first developing mode, the first developing unit operates to form an image of the color developed by the first developing unit. In the second developing mode, the second developing unit operates to form an image of the color developed by the second developing unit. The mode control means receives signals from the first and second detecting means and from the input means and controls the first developing.unit and the exchangeable unit in accordance with any of the said modes. When the outline forming unit is detected by the detecting means, the mode control means can select either the outline forming mode or the first developing mode. When the second developing unit is detected by the detecting means, the mode control means can select either the first developing mode or the second developing mode.

These objects and other features, aspects and advantages of the present invention will become more apparent from the following detailed description of the present invention when taken in conjunction with the accompanying drawings.

BRIEF DESCRIPTION OF THE DRAWINGS

FIGS. 12A, 13A, 14A, 15A and 16A show examples of original images; and

FIGS. 12B, 13B, 14B, 15B and 16B show outline images copied from the respective original images shown in FIGS. 12A, 13A, 14A, 15A and 16A.

DETAILED DESCRIPTION OF THE PREFERRED EMBODIMENTS

Figure 1:
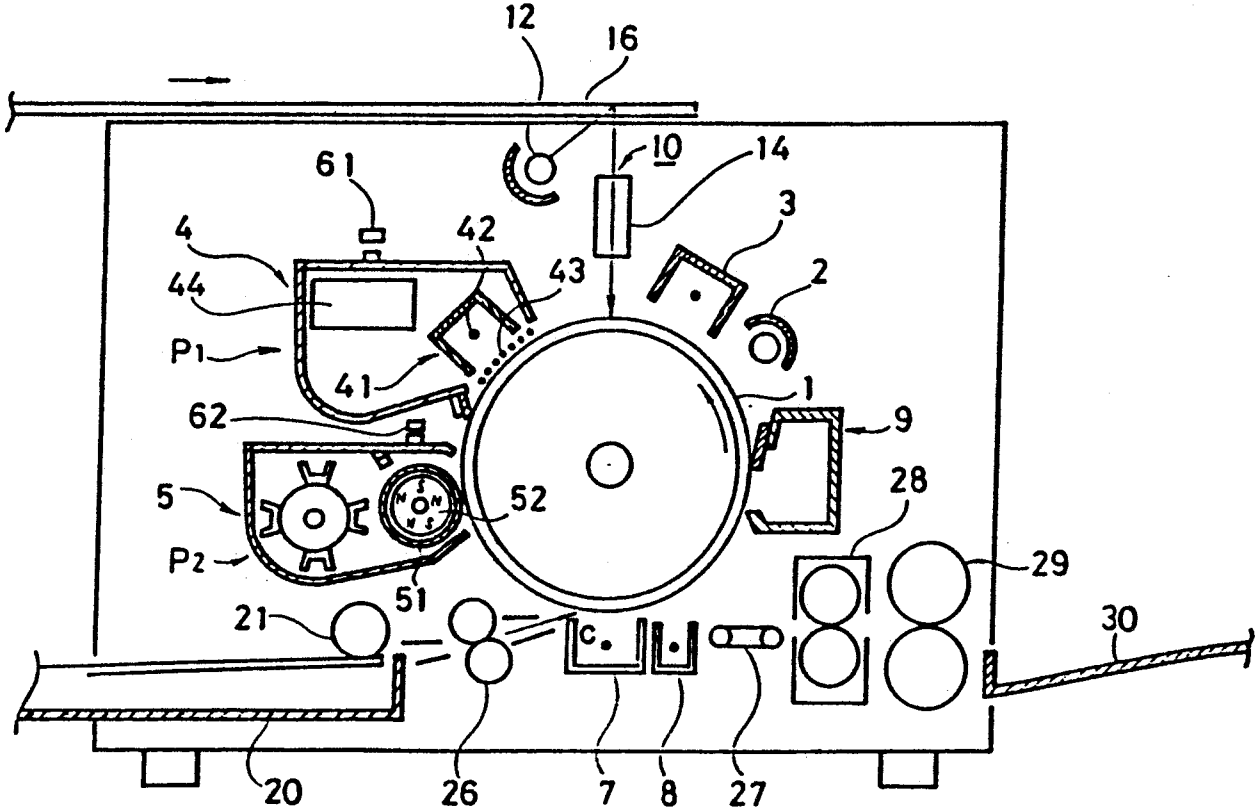
FIG. 1 is a schematic diagram of a copying machine in accordance with an embodiment of the present invention.

FIG. 1 is a vertical sectional schematic of a copying machine.

In the figure, a photoreceptor drum which can be rotatably driven counterclockwise is provided in the central portion of the body of the copying machine. An outline forming unit 4 is set at a first mounting position Pl and a developer unit 5 is set at a second mounting position P2 around the drum 1. An eraser lamp 2, a corona charger 3, a transfer charges 7, a separation charger 8 and a cleaning device 9 are arranged around the photoreceptor drum 1.

The photoreceptor drum 1 has a photoreceptor on the surface thereof. Passing through the corona charger 3, the surface of the drum 1 is uniformly charged and it is subjected to the image exposure from the optical system 10. The optical system 10 is provided below an original support 16 to scan the original image while the support 16 is moving. The system 10 comprises an exposure lamp 12, a lens 14, and the like.

A paper feeding member 20 having a paper feeding roller 21 is arranged at the bottom of the copying machine. A sheet of paper moves from the paper feeding member 20 through a timing roller pair 26, a conveyor belt 27, a fixing device 28 and a discharging roller pair 29 to a discharging tray 30.

The outline forming unit 4 comprises a scorotron charger 41 for applying charges having polarity opposite to the charges generated on the surface of the photoreceptor drum 1 by the corona charger 3, and a high voltage power supply 44 for supplying necessary voltages respectively to a charge wire 42 and a grid 43 of the scorotron charger 41.

The developer unit 5 is a well-known magnetic brush type device which comprises a developing sleeve 51 containing a magnet roller 52 of which peripheral surface is magnetized with N and S poles. The developer consists of a mixture of magnetic carriers and insulating toner. By frictional electrification, the magnetic carriers-are charged to have the same polarity as the corona charger 3, whereas the insulating toner is charged to have the polarity opposite to the corona charger 3. That is, the carriers and the toner are charged to have polarities opposite to each other. A developing bias voltage of the same polarity as the corona charger 3 is applied to the developing sleeve 51 by a bias power supplying device which will be described later.

The outline forming unit 4 and the developer unit 5 are detachable at respective positions, P1 and P2. A developer unit of a type different from the developer unit 5 can be set at position P1 instead of the outline forming unlt 4. More specifically, when the outline forming unit 4 and the developer unit 5 are mounted as shown in FIG. 1, an outline image can be obtained from the original image, with the color determined by the color of the developer unit 5. When a developer unit for developing an image in a color different from that provided by the developer unit 5 is mounted at position P1 instead of the outline forming unit 4, copying can be carried out with either of two colors, or a composite copy of two colors can be provided.

In the following description, an outline forming mode refers to a copying mode in which the outline forming unit 4 and the developer unit 5 are mounted at the first and second mounting portions P1 and P2, respectively, and the outline forming unit 4 is operated to obtain a copy with an outline enhanced image. A normal copying mode means, a copying mode in which normal copying is carried out. In the normal copying mode, the mode in which the developer unit 5 at the second mounting position P2 is operated for copying will be referred to as a first normal copying mode. The mode in which a developer unit set at the first mounting position P1 is operated for copying will be referred to as a second normal copying mode.

Provided adjacent to the units 4 and 5, respectively, are detecting sensors 61 and 62 for detecting the type or color of the unit mounted at the first mounting.position Pl and at the second mounting position P2. The detecting sensors 61 and 62 detect for example, magnets provided on the units which are to be set at respective positions and the sensors output 3 bit code signals. A CPU 201 (FIG. 4), which will be described later, determines.whether the.unit mounted at each of the positions P1 and P2 is the outline forming unit or the developer unit based on the code signals, and, if a developer unit is detected, it determines the color of the images to be produced by the unit.

Figure 2:
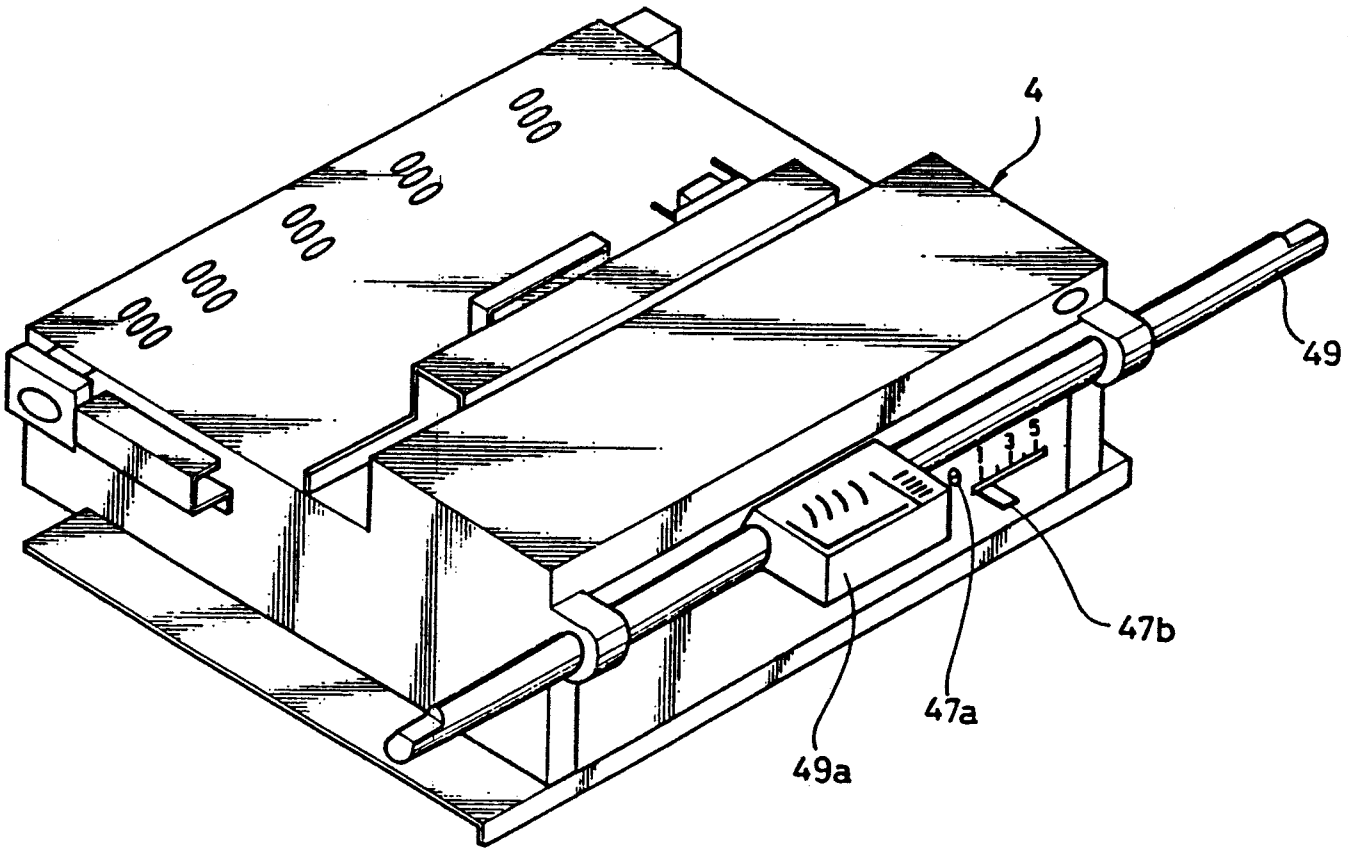
FIG. 2 is a perspective of an outline forming unit.

FIG. 2 is a perspective view of an embodiment of the outline forming unit 4.

The outline forming unit 4 can be mounted only at the first mounting position, P1. After it is inserted into the copying machine body and set at first mounting position P1, it is fixed to the body of the copying machine by a fixing arm 49 which is rotated with a knob 49*a*. Variable resistors 47*a* and 47*b* for adjusting an output voltage of a grid power supply device 46 (see FIG. 5) in a high voltage power supply device 44 are provided on a side of the outline forming unit 4. These variable resistors 47*a* and 47*b* are readily accessed for adjustment thereof by opening a side cover of the body of the copying machine.

Figure 3:
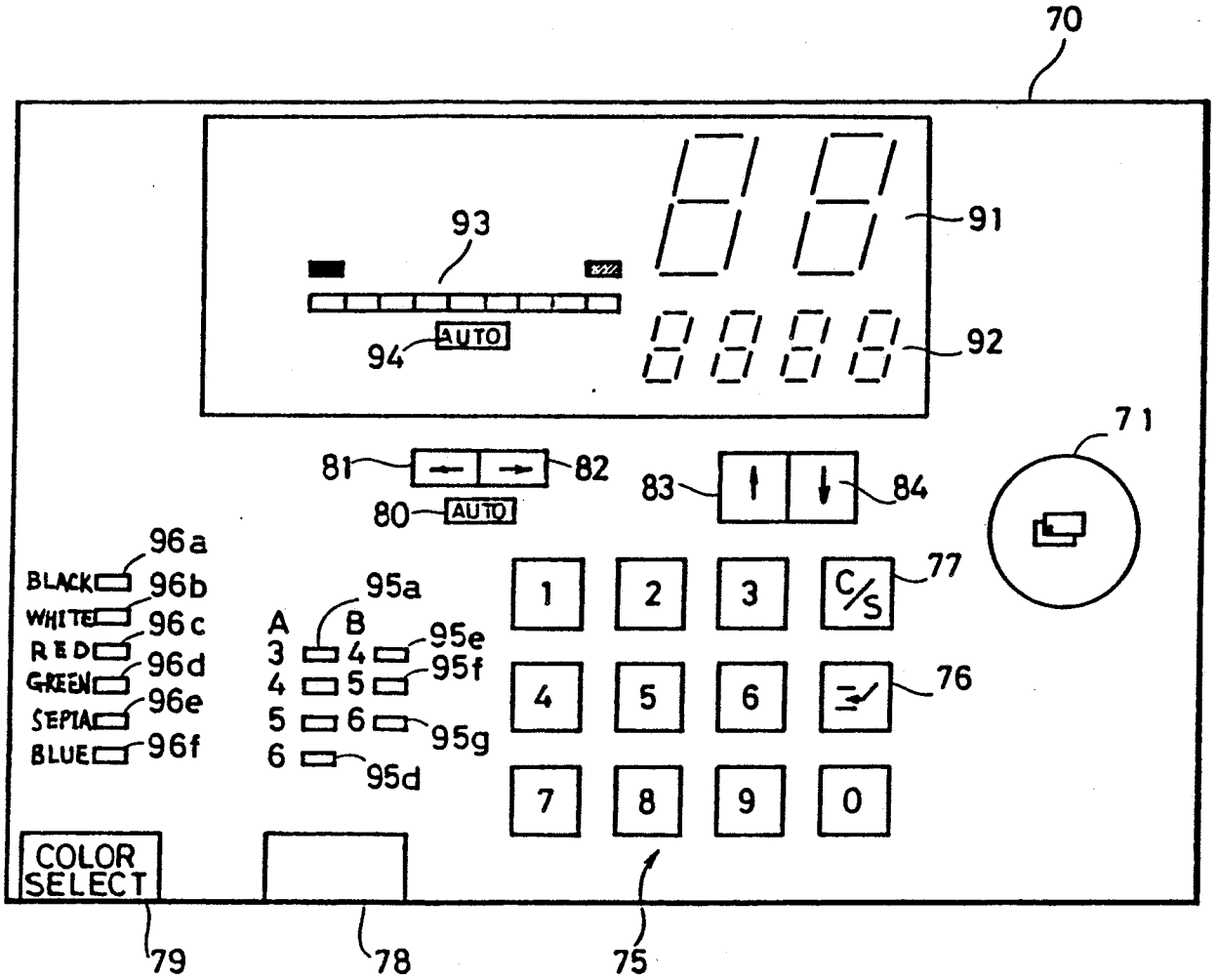
FIG. 3 is a plan view of an operation panel.

FIG. 3 is a plan view of the arrangement of various operation keys on the operation panel of the copying machine.

A print start key 71 for starting a copying operation, ten keys 75, an interruption key 76, a clear stop key 77, a paper selection key 78, a color select key 79 for designating the color of the copy, a key 80 for selecting between automatic and manual density adjustment, up and down keys 81 and 82 for manually adjusting the density, up and down keys 83 and 84 for designating copying magnification, a copy number display portion 91 for displaying the number of copies, to be made, a magnification display portion 92 for displaying the copying magnification, a density display portion 93 for manual adjustment of the density, an auto display portion 94 for selecting automatic density adjustment, size display portions 95*a* to 95*g* for displaying the selected size of the paper, color display portions 96a to 96f for displaying the selected color; and so on are arranged on the operation panel 70. Each of the said display portions employs an LED.

The color select key 79 and the color display portions 96*a* to 96*f* not only designate and display the color of copies but also select and display whether the outlines are to be formed or not by operating the outline forming unit as will be described later.

Figure 4:
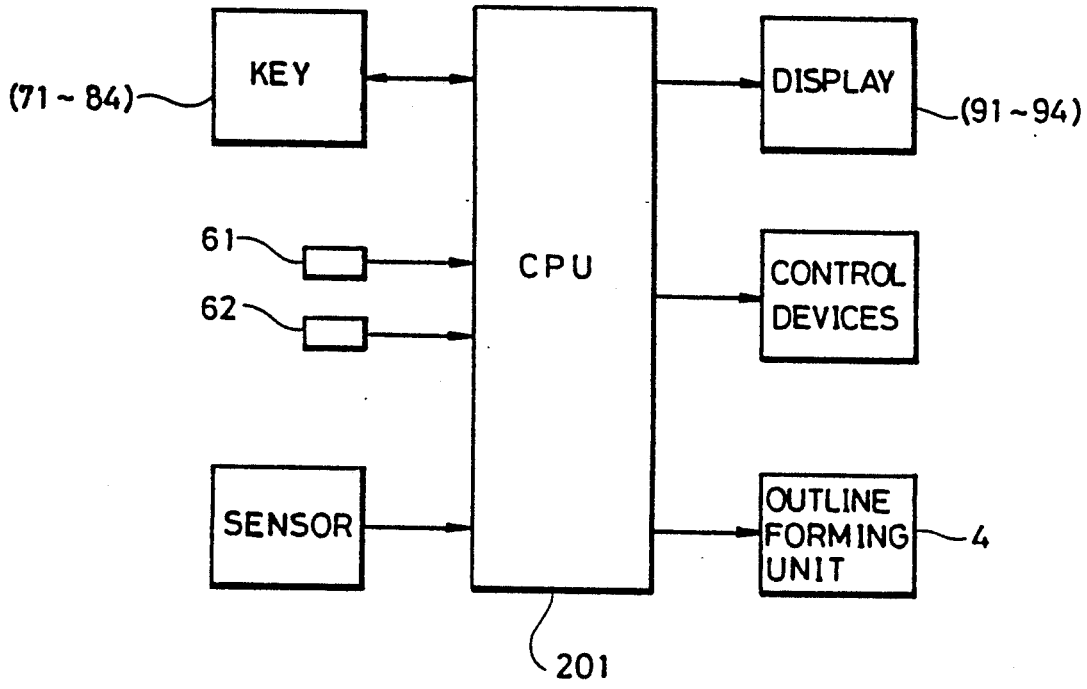
FIG. 4 is a block diagram of a control circuit of the copying machine.

FIG. 4 schematically shows a control circuit of the copying machine. Reference numeral 201 denotes,a CPU (central processing unit) comprising microcomputers. Connected to the CPU 201 are the above-described various input keys 71 to 84, various display portions 91 to 96, detecting sensors 61 and 62, other sensors, the outline forming unit 4, and control devices such as a motor, a clutch, the developer unit 5 and the like.

The CPU 201 can recognize that the outline forming unit 4 and the developer unit 5 are respectively set at the first and second mounting positions P1 and P2, and the color of images produced by the developer unit 5 based on the 3 bit code signals.from the detecting. sensors 61 and 62. Every time the color select key 79 is pressed, the activation and deactivation of the outline forming unit 4 is alternately designated. In the outline forming mode in which the outline forming unit 4 is activated, the color display portions 96*a* to 96*f* are all lit up to display the outline forming mode. When the outline forming unit 4 is not activated, only that portion out of the color display portions 96*a* to 96*f* which shows the color of the developer unit 5 is lit up. This operation will be described later.

Figure 5:
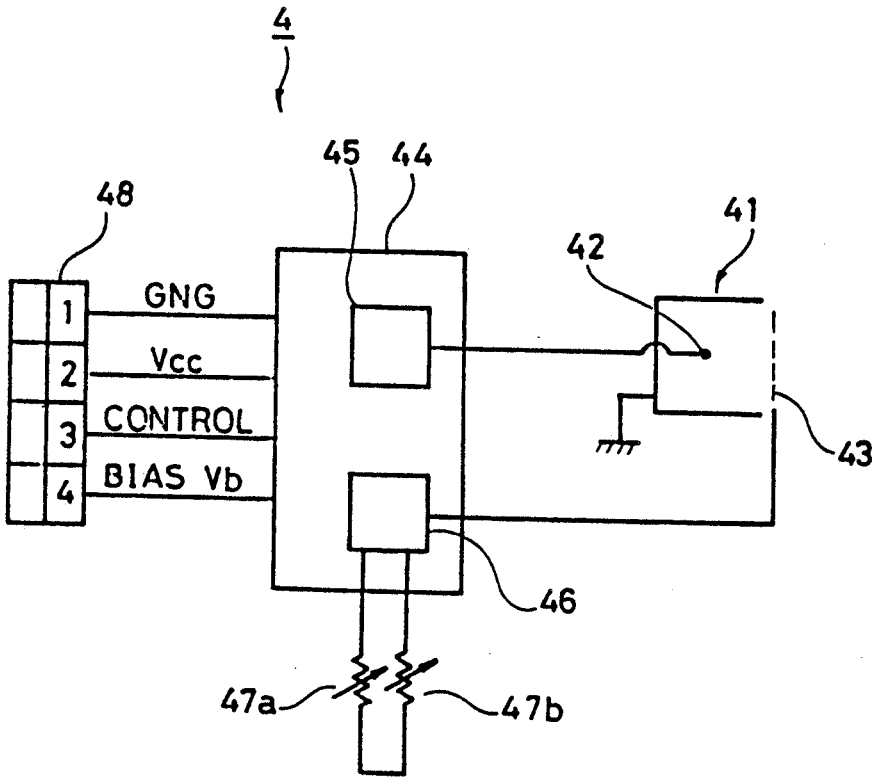
FIG. 5 is a schematic diagram of electric circuits in the outline forming unit.

FIG. 5 is a schematic circuit diagram of the outline forming unit 4.

The high voltage power supply device 44 comprises a charge power supply device 45 and a grid power supply device 46. The charge power supply device 45 outputs a charge voltage Vt to be supplied to the charge wire 42 of the scorotron charger 41. The grid power supply device 46 outputs a grid voltage Vg to be supplied to the grid-43. The grid voltage Vg outputted from the grid power supply device 46 can be varied by variable resistors 47*a* and 47*b*. These variable resistors 47*a* and 47*b* are connected in series with each other. One variable resistor 47*a* is for fine adjustment, and is adjusted during manufacturing or at the time of servicing for compensating for differences in the outline forming units 4. The other-variable registor 47*b* is to adjust the amount of enhancement of the outline, which can be readily accomplished by the operator of the copying machine by opening the cover of the body of the copylng machine and manipulating the resistor 47*b*. Reference numeral 48 denotes a terminal table.

Next, the process steps of the copying operation in the CPU 201, especially the process steps in association with the designation of the outline forming mode will be described with reference to the flowcharts of FIGS. 6 and 7.

Figure 6:
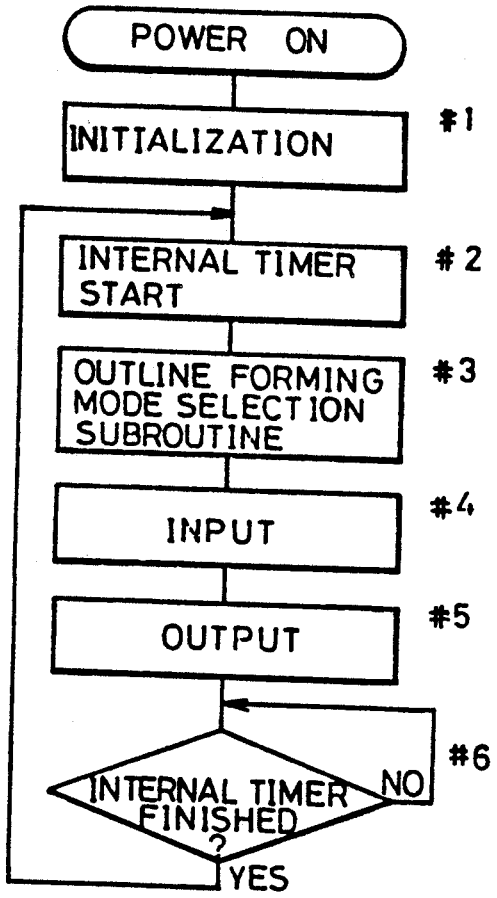
FIGS. 6 and 7 are flowcharts showing the operating process of the copying machine.

FIG. 6 shows the main flow of the CPU 201. When the power is turned on to start the program, the CPU 201 and an internal RAM are set at the initial state and all objects for control are initialized in the step #1. In the step #2, an internal timer for defining the time in which one routine is to be completed is started.

In the step. #3, whether the outline forming mode is selected or not is determined in association with the on/off of state the color select key 79. More specifically, in the step #3, an outline forming mode selection subroutine is carried out for determining whether the outline forming mode is selected or not and for displaying the operation mode.

In the step #4, input processing-from various keys such as the print start key 71 and from the sensors are carried out. In the step. #5, various output processing associated with the copying operation are carried out. Thereafter, in the step #6, a delay occurs until the time measured by the internal timer lapses in order that each individual routine is completed in a predetermined period of time.

Figure 7:
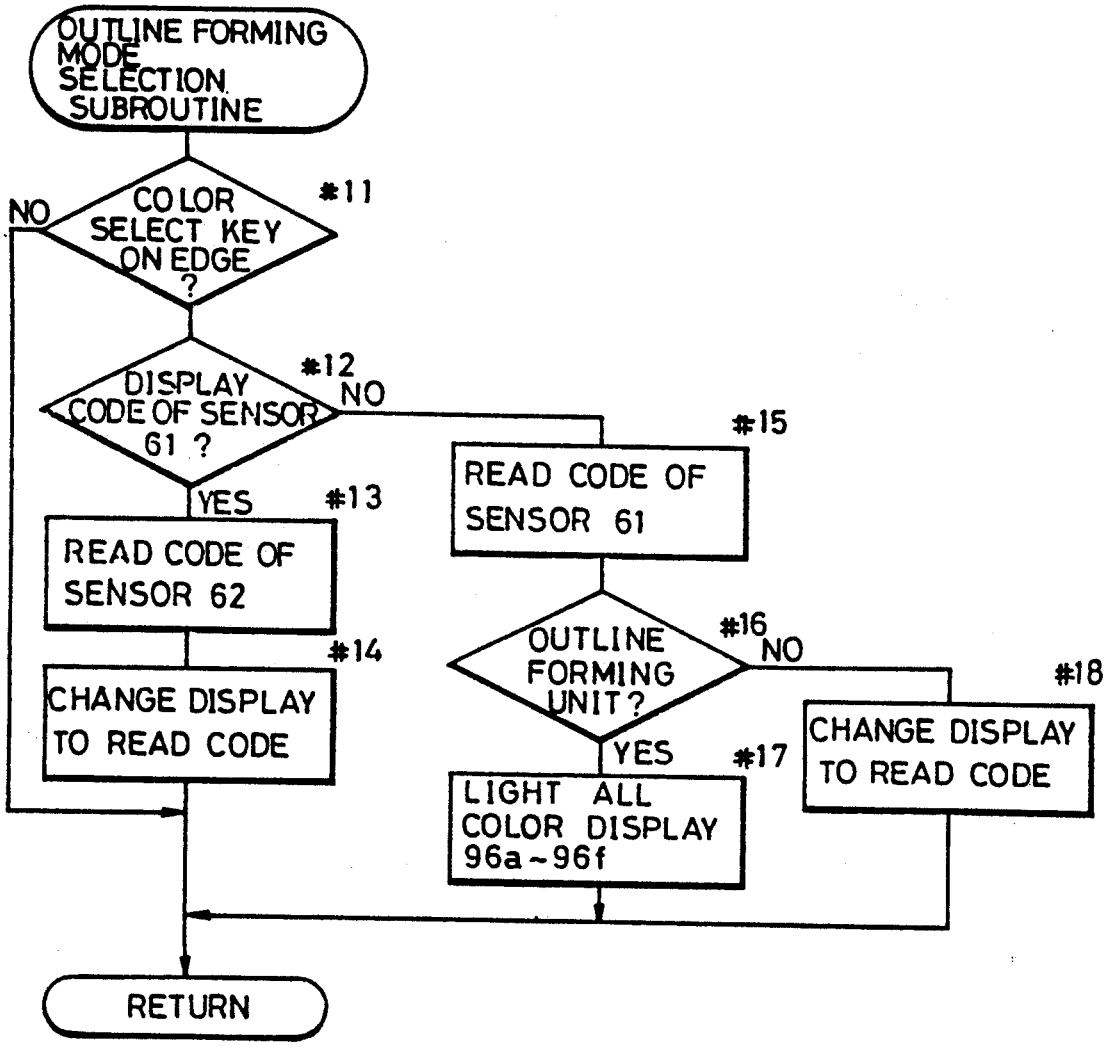

FIG. 7 shows a flowchart of the outline forming mode selection subroutine.

In the step #11, a change from the OFF state to the ON state (ON edge) of the color select key 79 is detected. In the step #12, it is determined whether the present display of the color display portions 96*a* to 96*f* corresponds to the codes detected by the detecting sensor 61, that is, which of the outline forming mode and the second normal copying.mode is selected as the copying mode. In the step #12, if it is determined that the color display portions 96*a* to 96*f* display the codes detected by the detecting sensor 61, the codes detected by the detecting sensor 62 are read in the step #13. In the step #14, the display of the color display portions 96*a* to 96*f* are changed to the display corresponding to the read codes, thereby selecting the first normal copying mode.

If it is determined that the display of the color display portions 96*a* to 96*f* does not correspond to the codes detected by the detecting sensor 61 in the step #12, the codes of the detecting sensor 61 are read in the step #15. In the step #16, it is determined whether the read code is the.code of the outline forming unit, namely, whether it is the outline forming unit or the developer unit that is mounted at the first mounting position P1. If it is determined that the code corresponds to the outline forming unit in the step #16, the color display portions 96a to 96f are all lit up in the step #17, thereby selecting the outline forming mode. Meanwhile, if it is determined that the code does not correspond to the outline forming unit in the step #16, namely, if it is determined that the developer unit is set at the first mounting position P1, the read code of the developer unit is displayed by the color display portions 96a to 96f in the step #18.

The copying operation in the outline forming mode, especially the outline forming operation, will be described below.

Figure 8:
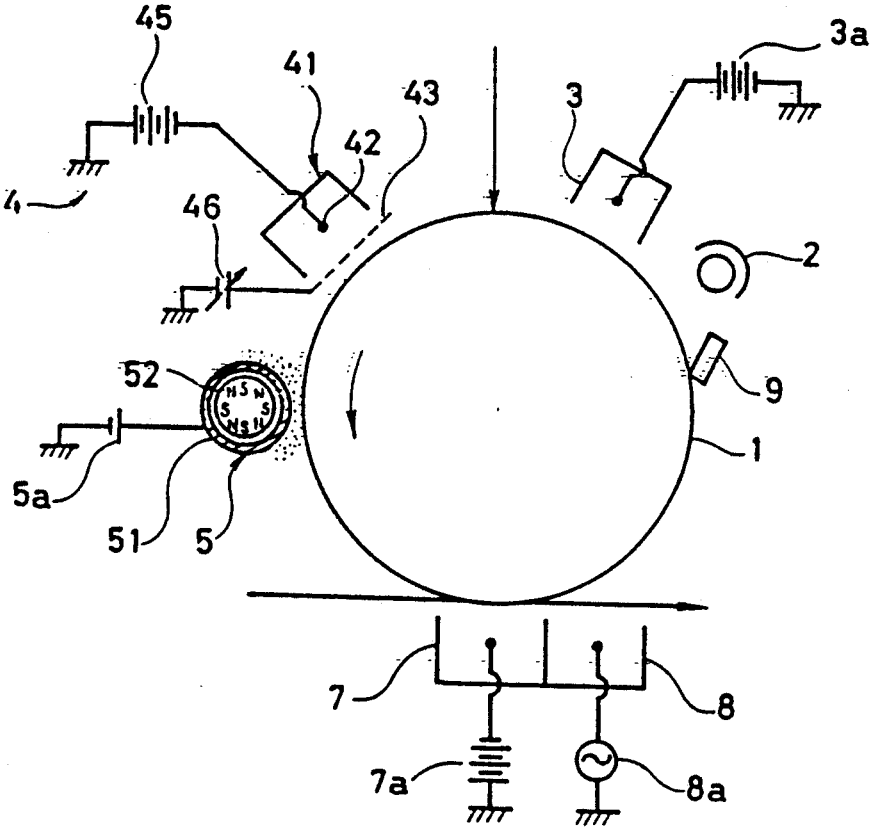
FIG. 8 is a schematic diagram of a photoreceptor drum and the peripheral members thereof.

FIG. 8 is a schematic diagram of the photoreceptor drum 1 and its peripheral elements in the copying machine.

In FIG. 8, a charge power supply device 45 is connected to the charge wire 42 of the scorotron charger 41. A grid power supply device 46 with variable voltage is connected. to the grid 43. A power supply 3a for charging the photoreceptor drum 1 is connected to the corona charger 3. A power supply 5a for applying developing bias voltage is connected to the developing sleeve 51 of the developing device 5. A power supply 7a for applying a voltage of the opposite polarity to the insulating toner is connected to the transfer charger 7. A power supply 8a for applying alternating voltage for discharging a sheet of paper is connected to the separating charger 8.

First, a case in which the outline of the original image is maximally enhanced, that is, only the outline of the image is drawn, will be described with reference to the FIGS. 9 and 10. Examples of the voltages applied to respective elements are as follows.

| | |
|---|---|
| Corona charger (power supply 3a) | +5500 V |
| Scorotron charger 41 | |
| Charge wire 42 (charge power supply device 45) | −6000 V |
| Grid 43 (grid power supply device 46) | +200 V |
| Grid voltage Vg | |
| Developing sleeve 51 (power supply 5a) | +300 V |
| Developing bias Vb | |
| Transfer charger 7 (power supply 7a) | +5500 V |

The grid voltage Vg is set at the above-described value by adjusting the variable registers 47a and 47b. The polarity of the respective voltages may be opposite to those indicated.

(1) First charging process

Charges of a prescribed potential are applied on the surface of the photoreceptor drum 1 by the corona-charger 3. Consequently, in the present embodiment, the surface potential of the photoreceptor drum 1 becomes approximately +600 V.

(2) Exposure process

Figure 10A:
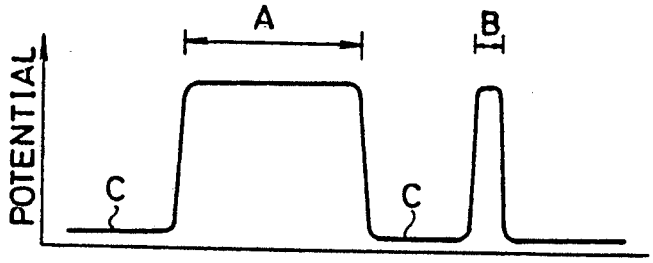
FIGS. 10A to 10C and FIGS. 11A to 11C are graphs showing the potential of the latent electrostatic image during respective operating processes.

The original image is exposed by the optical system 10 on the surface of the photoreceptor drum 1 which is charged to the potential of about +600 V, thereby forming a latent electrostatic image. On this occasion, the charges in the portions corresponding to the image portions A and B remain as the potential of +600 V while the charges in the portions corresponding to the non-image portion C are reduced to about +100 V by the photo illumination as shown in FIG. 10A. A positive image is used as the original image.

(3) Second charging process

Charges of a polarity opposite to that of the latent electrostatic image are applied by the scorotron charger 41 to the surface of the photoreceptor drum 1 on which the latent electrostatic image is formed in the exposure process. On this occasion, the grid voltage Vg of +200 V is applied to the grid 43. The polarity of the charges from the charge wire 42 of the scorotron charger 41 is opposite to that in the above-described first charging process. The grid voltage Vg is considerably lower than the surface potential (about +600 V) of the image portions A and B of the latent electrostatic image and is the same polarity as that in the first charging process. The grid voltage Vg is higher than the surface potential (about +100 V) of the non image portion C of the latent electrostatic image.

Figure 9:
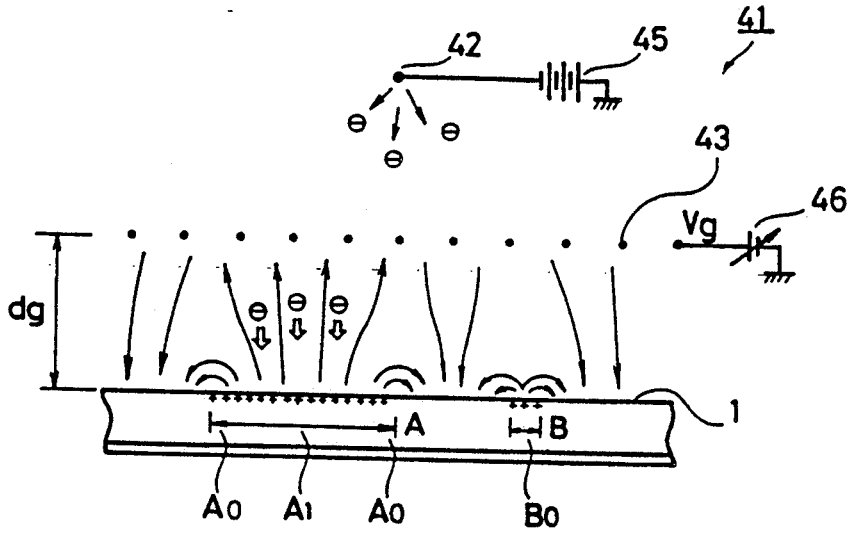
FIG. 9 is an explanatory diagram showing the electric lines of force in a second charging process for forming outlines.

The electric lines of force shown by the arrows in FIG. 9 are formed between the surface of the photoreceptor drum 1 and the grid 43. Ions of negative polarity generated from the charge wire 42 are guided along the electric lines of force. On this occasion, the electric lines of force which guide the negative ions to the surface of the photoreceptor drum 1 near the grid 43 are generated only at the central portion A1 and not at the outline portions A0 of the planar image portion A. Therefore, ions of negative polarity only reach the central portion A1 of the image portion A and not the outline portion A0 as shown by the arrows, and decrease the charges at the central portion to a potential approximately equal to the grid voltage Vg (+200 V).

Figure 10B:
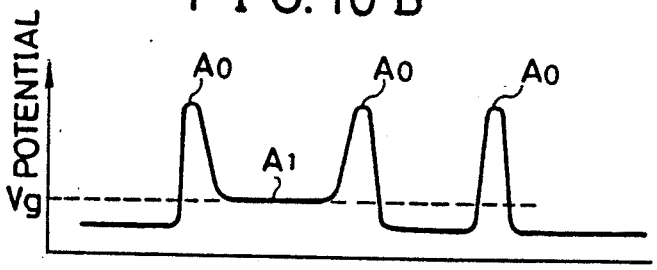

When described in association with the surface potential of the photoreceptor drum 1, the surface potential of the non-image portion C of the latent electrostatic image remains as a low potential portion of about +100 V as shown in FIG. 10B. The outline portions B0 and A0 of the line image portion B and of the planar image portion A, respectively, remain as high voltage portions of about +600 V, which is the initial surface potential. The potential of the central portion A1 of the planar image portion A is decreased approximately to the grid voltage Vg (+200 V).

Although the surface potential is not decreased in the line image portion B, the width of the charges becomes narrower to some extent. In other words, in the second charging process, the outlines of the image portions A and B are formed as positive latent electrostatic images.

The state of the electric lines of force varies depending on a distance dg between the grid 43 and the surface of the photoreceptor drum 1. Therefore, the width of the outline obtained as the image can be arbitrarily changed by changing the distance dg.

(4) Developing process

The latent electrostatic images formed as the positive images of the outline portions A0 and B0 in the above-described second charging process are developed by the developing device 5. On this occasion, the developing bias voltage Vb of +300 V is applied to the developing sleeve 51. The developing bias voltage Vb is slightly higher than the above-described grid voltage Vg (+200 V) and has the same polarity as the voltage impressed in the corona charger during the first charging process.

Figure 10C:
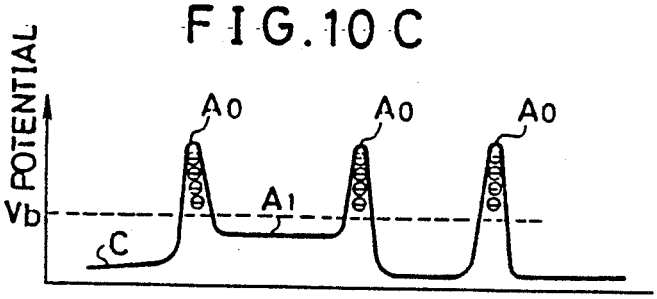

Consequently, the insulating toner charged to the negative polarity is applied only on the high potential portion of the photoreceptor drum 1, that on, the outline portions A0 and B0 of the image portions A and B, as shown in FIG. 10C, whereby a toner image of a so-called "inner lining" is formed by the normal development.

The toner image is transferred to a sheet of paper by the transfer charger 7 and is fixed by the fixing device 28.

Meanwhile, the above-described grid voltage Vg is set considerably lower than the surface potential of the image portions A and B of the latent electrostatic image in order to lower the surface potential of the central portion A1 of the image portion of the latent electrostatic image relative to that of the outline portion A0. The above-described developing bias voltage Vb is set slightly higher than the grid voltage Vg in order to prevent the toner from being applied to the non-image portion C and to the central portion A1 of the image portion A of the latent electrostatic image whose surface potential was decreased in the second charging process.

Figure 11A:
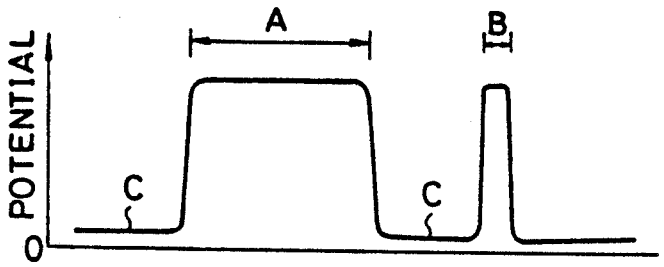

In the above-described example, only the outline of the original image is extracted. By variably adjusting the grid voltage Vg, the portions located inwardly of the outline can have a selected density, thereby providing a half tone portion. This will be described in the following with reference to FIGS. 11A to 11C.

By adjusting the variable resistor 47*b* provided on the side surface of the outline forming unit 4, the grid voltage Vg is adjusted so as to be higher than that of the above-described example (+200 V) and higher than the developing bias voltage Vb (+300 V). Now, the grid voltage Vg is set at, for example, about 400 V.

Figure 11B:
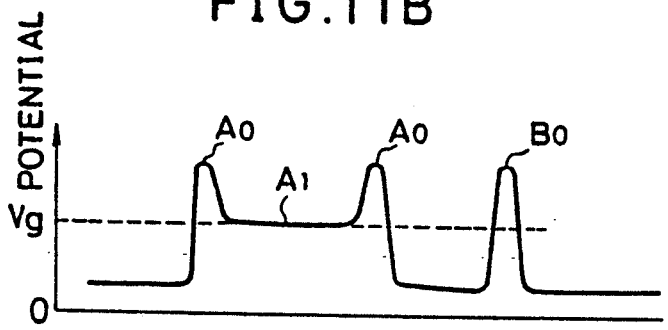
Figure 11C:
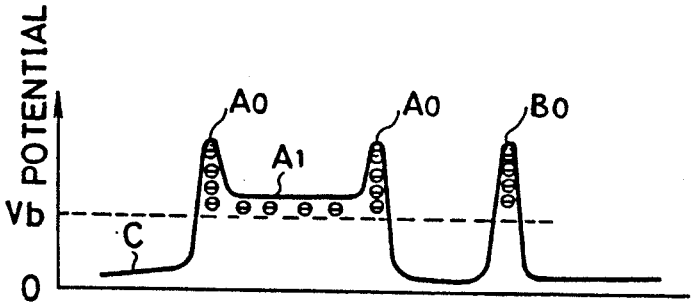

When the copying operation is carried out in the manner similar to that described above, charges of the polarity opposite to the latent electrostatic image are applied by the scorotron charger 41 on the surface of the photoreceptor drum 1 during the second charging process after the exposure process. Consequently, the potential at the central portion A1 of the planar image portion A decreases approximately to the grid voltage Vg (about +400 V) as shown in FIG. 11B.

Thereafter, in the developing process, the insulating toner charged to the negative polarity is applied to the outline portions A0 and B0 and to the central portion A1 of the image portions A and B on the photoreceptor drum 1 to form toner images, which are transferred and fixed to the sheet of copy paper. At this time, much toner is applied to the outline portions A0 and B0, while only a little toner is applied to the central portion A1. Consequently, the outline (outline portions A0 and B0) of the toner image is enhanced while the inner portions (the central portion A1) assume a half tone state with lower density.

As is shown in the above examples, by adjusting the variable resistors 47*a* and 47*b* of the outline forming unit 4 to variably adjust the grid voltage Vg, an image with the outline enhanced maximally (only the outline image) or an image with the outline enhanced to some extent (an image with the portion located within the outline being produced with a toner density less than that at the outline can be easily formed based on the same original image. Therefore, a new design can be provided and various usages and effects can be provided as described in the foregoing. In addition, the consumed amount of toner, that is the developer, can be reduced, thereby reducing the cost of copying.

For example, the letter image shown in FIG. 12A provides an image quite different in design from that shown in FIG. 12B by maximally enhancing the outline thereof, that is, forming only with the outlines of the painted original image.

If only an outline is formed from a painted finished picture such as that shown in FIG. 13A, a picture which may be called imperfect with no portion thereof painted is provided as shown in FIG. 13B. The picture such as that shown in FIG. 13B may be used by children for education or play as a picture for coloring.

Figure 14A:
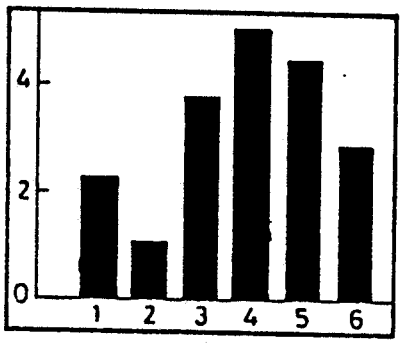
Figure 14B:
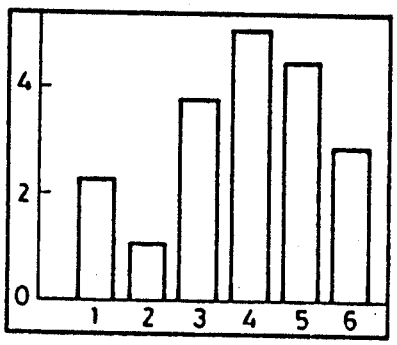

If only an outline is formed from a normal bar graph such as that shown in FIG. 14A, the inside of the bars showing the statistical amounts becomes white as shown in FIG. 14B. Numerals, characters and so on can be written in that portion.

Figure 15A:
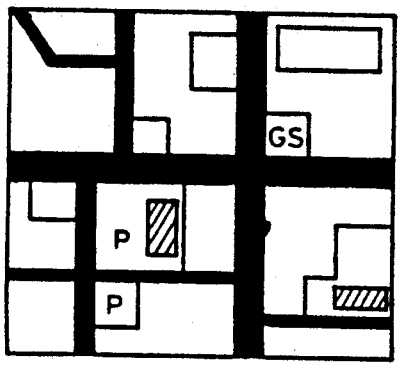
Figure 15B:
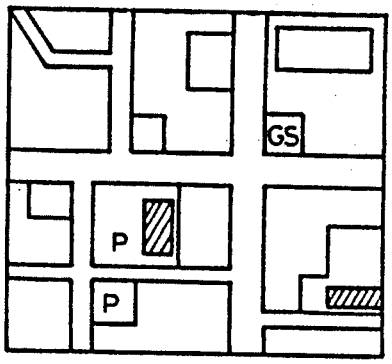

In the map shown in FIG. 15A, marks representing buildings and the like and characters are drawn by normal lines, but the roads are painted black. Therefore, letters such as "route 1" or the "international street" and the like can not be written in the portion of the road. However, if only an outline is extracted from the original map, a map is obtained in which the roads and streets are blank as shown in FIG. 15B, and required letters or characteristics can be written therein. If the streets and roads are painted by a felt pen and the like having a large pen point, and thereafter only the outline thereof is extracted, a map can be readily produced in which there is no unnecessary line at the intersection of the streets.

In FIG. 16A, some words in sentences are blackened by a felt pen or the like. If only an outline is extracted from this image, as shown in FIG. 16B, rectangular frames are provided at the blackened words, which can be utilized as a paper for examination.

In the above-described embodiment, the display and designation of the outline forming mode, that is, the selection of the operation of the outline forming unit 4 are facilitated by the color select key 79 and the color display portions 96*a* to 96*f*. Therefore, there is no need to provide special keys and display portions for designating the outline forming mode. Therefore, the manufacturing cost can be suppressed and the operation panel 70 will not be complicated, allowing simple operation.

In the above-described embodiment, the charge power supply device 45 and the grid power supply device 46 are a composite structure forming the high voltage power supply device 44; however, the power supply devices may be independent power supply devices.

Since the variable resistors 47*a* and 47*b* for adjusting outputs of the grid power supply device 46 are provided on the side surface of the outline forming unit 4, the number of poles of connectors and the like for connecting the outline forming unit 4 and the body of the copying machine is small. Meanwhile, if the variable resistor 47*b* is arranged on a surface of the operation panel of the copying machine, there will be no need to open the covers of the copying machine, whereby the adjustment of the density of the portion within the the outline can be more easily adjusted, and adjustment can be carried out during the copying operation.

Although two variable resistors 47*a* and 47*b* are used in the above-described embodiment, one variable resistor may be sufficient. Other analog amount adjusting devices may be used instead of the variable resistors 47*a* and 47*b*. The output voltage of the grid power supply device 46 may be changed by employing a counter or an encoder generating digital signals corresponding to the amount of operation and a D/A converter for converting the digital signals into analog signals, or the output voltage may be changed directly by the digital signals.

Although all of the color display portions 96*a* to 96*f* are lit up to display the outline forming mode in the above-described embodiment, not all of them need be lit up. For example, two color display portions 96*a* and 96*b* respectively showing "black" and "white" may be lit up, or the color display portion 96*a* representing "black" may be flickered. If a display portion representing "color" is provided, the display portions displaying "black" and "color" may be lit up.

Although the color select key 79 and the color display portion 96*a* to 96*f* are directly used for designating and displaying the outline forming mode in the above-described embodiment, display portions displaying "outline forming" or "other operation" may be provided in the color display portions 96*a* to 96*f*.

Although the developer unit 5 is detachable at the second mounting position P2, it may be fixed to the copying machine thereat.

Although a method was described in which an outline image is taken from along the inner side of the a positive original image, the present invention is not limited to apparatus which carries out this method. For example, the present invention includes an image forming apparatus employing a method in which an outline image is taken from along the outer side of a positive image as disclosed in U.S. Pat. No. 4,792,775 by the same applicant of the present invention, or the present invention may include an image forming apparatus employing a method in which outline images are taken from along the inner side or outer side of a negative original, as disclosed in U.S. Pat. No. 4,828,953 issued May 9, 1989, by changing the polarity or method of development (normal development or inverted development) of the scorotron charger 41.

Although a copying machine was described in which the original image is optically scanned to expose the photoreceptor, the present invention may be applied to a laser printer in which exposure is carried out by a laser beam the light intensity of which is modulated by the image.

As described above, according to the present invention, an image of only an enhanced outline or an outline image of the original image can be easily formed. Consequently, new designs are provided, enabling various practical applications. In addition, the consumed amount of the developer can be reduced, thereby reducing the cost of forming images. Since there is no need to provide special keys and the like for designating the operation of the outline forming unit, there will be no additional keys on the operation panel, whereby the manufacturing cost can be suppressed.

Although the present invention has been described and illustrated in detail, it is clearly understood that the description is by way of illustration and example only and is not to be taken by way of limitation, the spirit and scope of the present invention being limited only by the terms of the appended claims.

What is claimed is:

1. An electrophotographic image forming apparatus capable of selectively forming a copy of an original image in which the outline of the original image is enhanced and a color reproduction of an original image, said apparatus comprising:

a photoreceptor drum rotatably supported in the apparatus, and means for rotating said photoreceptor drum in a predetermined direction of rotation;

corona charger means confronting the periphery of said photoreceptor drum for facilitating the formation of a latent electrostatic image on said drum that corresponds to the original image;

a first developing unit confronting the periphery of said photoreceptor drum at a location downstream of said corona charger means with respect to said direction of rotation, said first developing unit operable to develop the electrostatic latent image into a color image;

a unit mounting portion confronting the periphery of said photoreceptor drum upstream from said first developing unit with respect to said direction of rotation;

an exchangeable unit detachably mounted to the apparatus at said unit mounting portion, said exchangeable unit being one of an outline forming unit having a scorotron charger operable to develop said latent electrostatic image into an image corresponding to the original image but with the outline thereof enhanced and a second developing unit operable to develop the electrostatic latent image into a color image corresponding to the original image;

detecting means for detecting whether the exchangeable unit mounted at said unit mounting portion is said outline forming unit or said second developing unit;

mode control means operatively connected to said detecting means for selectively establishing one of two different sets of copying modes in the apparatus depending upon whether said detecting means detects said outline forming unit or said second developing unit at said unit mounting portion, the first one of said sets of copying modes including an outline forming mode in which the mode control means can activate said outline forming unit to facilitate the formation of a copy of the original image with the outline thereof enhanced, and a first developing mode in which the mode control means can activate said first developing unit to facilitate the formation of a reproduction of the original image in a color associated with said first developing unit, when said detecting means detects said outline forming unit at said unit mounting portion, the second one of said sets of copying modes including a second developing mode in which the mode control means can activate said second developing unit to facilitate the formation of a reproduction of the original image in a color associated with said second developing unit, and said first developing mode, when said detecting means detects said second developing unit at said unit mounting portion; and input means operatively connected to said control means for causing said control means to carry out one of the modes in the respective one of said sets thereof that is established in the apparatus based on the detection by said detecting means, said input means including only a single key which alternately readies said mode control means to activate either said outline forming unit or said first developing unit when said key is successively pressed by an operator while said first one of said sets of copy modes is established, and which alternately readies said mode control means to activate either said first developing unit or said second developing unit when said key is successively pressed by an operator while said second one of said sets of copying modes is established.

2. An image forming apparatus as claimed in claim 1, and further comprising a plurality of display elements respectively associated with each of said colors; and display control means operatively connected to said input means and to display elements for causing a respective one of said display units to display the color associated with said first developing unit when said input means readies said mode control means to activate said first developing unit, and for causing another one of said display units to display the color associated with said second developing unit when said input means readies said mode control means to activate said second developing unit.

3. An image forming apparatus as claimed in claim 2, wherein said display control means also causes said display units to display all of said colors when said input means readies said mode control means to activate said outline forming unit.

4. An electrophotographic image forming apparatus capable of selectively forming a copy of an original image in which the outline of the original image is enhanced and a color reproduction of an original image, said apparatus comprising:

a photoreceptor drum rotatably supported in the apparatus, and means for rotating said photoreceptor drum in a predetermined direction of rotation;

corona charger means confronting the periphery of said photoreceptor drum for facilitating the formation of a latent electrostatic image on said drum that corresponds to the original image;

a first unit mounting portion confronting the periphery of said photoreceptor drum downstream from said corona charger means with respect to said direction of rotation;

a first developing unit detachably mounted to the apparatus at said first unit mounting portion, said first developing unit operable to develop the electrostatic latent image into a color image;

first detecting means for detecting the color in which said first developing unit is operable to develop the electrostatic latent image;

a second unit mounting portion confronting the periphery of said photoreceptor drum upstream from said first unit mounting portion and downstream from said corona charger means with respect to said direction of rotation;

an exchangeable unit detachably mounted to the apparatus at said second unit mounting portion, said exchangeable unit being one of an outline forming unit having a scorotron charger operable to develop the latent electrostatic image into an image corresponding to the original image but with the outline thereof enhanced and a second developing unit operable to develop the electrostatic latent image into a color image corresponding to the original image;

second detecting means for detecting whether the exchangeable unit mounted at said second unit mounting portion is said outline forming unit or said second developing unit;

mode control means operatively connected to said first and to said second detecting means for selectively establishing different sets of copying modes in the apparatus depending upon the color detected by said first detecting means and upon whether said second detecting means detects said outline forming unit or said second developing unit at said unit mounting portion, a first one of said sets of copying modes including an outline forming mode in which the mode control means can activate said outline forming unit to facilitate the formation of a copy of the original image with the outline thereof enhanced, and a first developing mode in which the mode control means can activate said first developing unit to facilitate the formation of a reproduction of the original image in a color associated with said first developing unit, when said second detecting means detects said outline forming unit at said second unit mounting portion, a second one of said sets of copying modes including a second developing mode in which the mode control means can activate said second developing unit to facilitate the formation of a reproduction of the original image in a color associated with said second developing unit, and said first developing mode, when said second detecting means detects said second developing unit at said second unit mounting portion; and input means operatively connected to said control means for causing said control means to carry out one of the modes in the respective one of said sets thereof that is established in the apparatus based on the detection by said detecting means, said input means including only a single key which alternately readies said mode control means to activate either said outline forming unit or said first developing unit when said key is successively pressed by an operator while said first one of said sets of copy modes is established, and which alternately readies said mode control means to activate either said first developing unit or said second developing unit when said key is successively pressed by an operator while said second one of said sets of copying modes is established.

5. An image forming apparatus as claimed in claim 4, and further comprising display means operatively connected to said input means for displaying the color detected by said first detecting means when said input means readies said mode control means to activate said first developing unit, and for displaying the color associated with said second developing unit when said second detecting means detects said second developing unit and said input means readies said mode control means to activate said second developing unit.

6. An image forming apparatus as claimed in claim 5, wherein said display means also displays all of said colors when said input means readies said mode control means to activate said outline forming unit.

* * * * *